US011209192B2

(12) United States Patent
Veprik

(10) Patent No.: US 11,209,192 B2
(45) Date of Patent: Dec. 28, 2021

(54) CRYOGENIC STIRLING REFRIGERATOR WITH A PNEUMATIC EXPANDER

(71) Applicant: CRYO TECH LTD., Ein Harod (IL)

(72) Inventor: Alexander Veprik, Kiriyat Motzkin (IL)

(73) Assignee: Cryo Tech Ltd., Ein Harod (IL)

( * ) Notice: Subject to any disclaimer, the term of this patent is extended or adjusted under 35 U.S.C. 154(b) by 268 days.

(21) Appl. No.: 16/525,535

(22) Filed: Jul. 29, 2019

(65) Prior Publication Data

US 2021/0033313 A1 Feb. 4, 2021

(51) Int. Cl.

| | |
|---|---|
| ***F25B 9/14*** | (2006.01) |
| ***F02G 1/044*** | (2006.01) |
| ***F02G 1/057*** | (2006.01) |
| ***F02G 1/047*** | (2006.01) |
| ***F02G 1/053*** | (2006.01) |

(52) U.S. Cl.

CPC ..... *F25B 9/14* (2013.01); *F02G 1/044* (2013.01); *F02G 1/047* (2013.01); *F02G 1/057* (2013.01); *F02G 1/0535* (2013.01); *F02G 2243/202* (2013.01); *F02G 2243/38* (2013.01); *F02G 2275/20* (2013.01)

(58) Field of Classification Search

CPC ..... F25B 9/14; F25B 2309/1428; F02G 1/04; F02G 1/044; F02G 1/053; F02G 1/05; F02G 1/0535; F02G 1/055; F02G 1/057

USPC ..... 62/6, 238.2; 60/508–515, 516–531

See application file for complete search history.

(56) References Cited

U.S. PATENT DOCUMENTS

| | | | | |
|---|---|---|---|---|
| 3,991,585 A | | 11/1976 | Mulder | |
| 4,019,335 A | * | 4/1977 | Browning | F02G 1/0435 62/6 |
| 4,143,520 A | * | 3/1979 | Zimmerman | F02G 1/043 62/6 |

(Continued)

FOREIGN PATENT DOCUMENTS

| | | | | |
|---|---|---|---|---|
| GB | 2455566 A | * | 6/2009 | F02G 1/0435 |
| JP | 60101249 A | * | 6/1985 | F02G 1/0435 |

(Continued)

OTHER PUBLICATIONS

Veprik, A., et al., "Adaptation of the low-cost and low-power tactical split Stirling cryogenic cooler for aerospace applications", Infrared Technology and Applications XXXVII, vol. 8012, International Society for Optics and Photonics, p. 80122I, Dec. 2011.

(Continued)

*Primary Examiner* — Mark A Laurenzi
*Assistant Examiner* — Mickey H France
(74) *Attorney, Agent, or Firm* — Pearl Cohen Zedek Latzer Baratz LLP

(57) ABSTRACT

A split Stirling cryogenic refrigerator device may include a resonant pneumatic expander comprising a resonant displacer assembly supported by a spring and configured to slide back and forth along a longitudinal axis within a housing of the resonant pneumatic expander, the resonant displacer assembly comprising a tubular displacer containing a regenerator and coupled to a sealing piston, and a driving piston coupled to the sealing piston by an elongated radially compliant and axially rigid connecting member.

19 Claims, 5 Drawing Sheets

(56) References Cited

U.S. PATENT DOCUMENTS 4,244,192 A * 1/1981 Chellis ..... F04B 39/042 277/438
4,277,947 A * 7/1981 Durenec ..... F25B 9/14 62/6
4,281,517 A * 8/1981 Zimmerman ..... F02G 1/0445 62/6
4,355,519 A * 10/1982 Kercheval ..... F16J 9/00 277/449
4,385,499 A * 5/1983 Lam ..... F25B 9/14 62/6
4,404,808 A * 9/1983 Andeen ..... F25B 9/14 62/6
4,417,448 A * 11/1983 Horn ..... H02K 33/14 310/35
4,425,764 A * 1/1984 Lam ..... F25B 9/14 165/10
4,433,550 A * 2/1984 Durenec ..... F25B 9/14 60/520
4,475,335 A * 10/1984 Davey ..... F02B 71/04 60/520
4,501,120 A * 2/1985 Holland ..... F02G 1/0445 277/411
4,534,176 A * 8/1985 Horn ..... F25B 9/14 60/520
4,539,818 A * 9/1985 Holland ..... F02G 1/0535 60/520
4,543,792 A * 10/1985 Bertsch ..... F02G 1/0445 123/193.6
4,545,209 A * 10/1985 Young ..... F02G 1/0445 310/12.04
4,553,398 A * 11/1985 Young ..... F25B 9/14 417/340
4,574,591 A * 3/1986 Bertsch ..... F04B 15/08 60/520
4,578,956 A * 4/1986 Young ..... F02G 1/0445 310/12.04
4,606,194 A * 8/1986 Pirtle ..... F25B 9/14 60/520
4,642,988 A * 2/1987 Benson ..... F02G 1/0435 60/518
4,664,685 A * 5/1987 Young ..... F02G 1/0435 318/617
4,697,113 A * 9/1987 Young ..... F25B 9/14 310/15
4,745,749 A * 5/1988 Benson ..... F02G 1/0435 60/518
4,754,608 A * 7/1988 Bertsch ..... F16J 1/16 60/520
4,822,390 A * 4/1989 Kazumoto ..... F04B 35/045 60/520
4,846,861 A * 7/1989 Berry ..... F02G 1/0445 62/6
4,858,442 A * 8/1989 Stetson ..... F25B 9/14 62/6
4,862,695 A 9/1989 Kushnir
4,922,722 A * 5/1990 Kazumoto ..... F16F 1/08 267/168
4,979,368 A * 12/1990 Stetson ..... F25B 9/14 220/288
5,018,357 A * 5/1991 Livingstone ..... F25B 9/14 60/520
5,036,670 A * 8/1991 Morris ..... F25B 9/14 62/6
5,040,372 A * 8/1991 Higham ..... F16F 7/116 62/6
5,048,297 A * 9/1991 Sarcia ..... F25B 9/14 60/520
5,048,368 A * 9/1991 Mrdjenovich ..... F16C 7/023 74/579 E
5,056,317 A * 10/1991 Stetson ..... F25B 9/14 62/6
5,063,992 A * 11/1991 Mrdjenovich ..... F16C 7/023 164/516
5,088,288 A * 2/1992 Katagishi ..... F25B 9/14 62/228.1
5,113,662 A * 5/1992 Fujii ..... F04B 35/045 60/520
5,140,869 A * 8/1992 Mrdjenovich ..... B22D 25/02 74/579 E
5,146,124 A * 9/1992 Higham ..... F16F 7/116 310/17
5,214,922 A * 6/1993 Dopazo ..... F25B 9/14 62/6
5,318,412 A * 6/1994 Laskaris ..... F04B 35/045 417/417
5,329,768 A * 7/1994 Moscrip ..... F02G 1/0435 60/518
5,345,769 A * 9/1994 Liepert ..... F25B 9/14 60/520
5,477,686 A * 12/1995 Minas ..... F25B 9/14 60/520
5,542,254 A * 8/1996 Pruitt ..... F25B 9/14 62/295
5,579,399 A * 11/1996 Lucas ..... G10K 11/04 381/165
5,596,875 A * 1/1997 Berry ..... F16F 7/1005 62/520
5,642,618 A * 7/1997 Penswick ..... F02G 1/0435 60/520
5,647,217 A * 7/1997 Penswick ..... F25B 9/14 60/520
5,749,226 A * 5/1998 Bowman ..... F02G 1/0435 257/E23.096
5,813,235 A * 9/1998 Peterson ..... F25B 9/14 60/518
5,907,201 A * 5/1999 Hiterer ..... H02K 33/16 310/30
6,062,023 A * 5/2000 Kerwin ..... F02G 1/043 60/520
6,094,912 A * 8/2000 Williford ..... F02G 1/043 60/517
6,141,971 A * 11/2000 Hanes ..... F25B 9/14 310/15
6,199,381 B1 * 3/2001 Unger ..... F02B 71/04 60/520
6,779,349 B2 * 8/2004 Yoshimura ..... F25B 9/14 62/6
7,137,259 B2 * 11/2006 O'Baid ..... F25B 9/14 62/6
8,196,415 B2 6/2012 Veprik
8,615,993 B2 * 12/2013 Berchowitz ..... F02G 1/0435 60/520
8,910,486 B2 12/2014 Bin-Nun et al.
9,574,797 B2 * 2/2017 Bin-Nun ..... F25B 9/14
9,689,344 B1 * 6/2017 Gedeon ..... F02G 1/0435
2002/0174661 A1 * 11/2002 Sylvia ..... F16F 1/328 62/6
2003/0101733 A1 * 6/2003 Ogura ..... F25D 11/00 62/6
2003/0219350 A1 * 11/2003 Meijers ..... F04B 35/045 417/416
2004/0093873 A1 * 5/2004 Ogura ..... F04B 35/045 62/6
2005/0039454 A1 * 2/2005 Shimizu ..... F02G 1/0435 60/595
2005/0060996 A1 * 3/2005 Pellizzari ..... F16F 1/06 60/517
2006/0137339 A1 * 6/2006 Sakamoto ..... F02G 1/053 60/520
2006/0254270 A1 * 11/2006 Tanaka ..... F02G 1/045 60/517
2007/0089410 A1 * 4/2007 Yoshimura ..... F02G 1/043 60/520
2007/0151239 A1 * 7/2007 Sakamoto ..... F02G 1/053 60/520
2007/0256428 A1 * 11/2007 Unger ..... H02K 11/33 62/6

(56) References Cited

U.S. PATENT DOCUMENTS

2007/0261407 A1* 11/2007 Bin-Nun ..... F25B 9/14 60/645
2007/0277521 A1* 12/2007 Tanaka ..... F02G 1/0435 60/517
2008/0047265 A1* 2/2008 Hill ..... F02G 1/0435 60/517
2008/0256945 A1* 10/2008 Welty ..... F02G 1/0435 60/520
2008/0282694 A1* 11/2008 Kitamura ..... F02G 1/0435 60/517
2009/0094977 A1* 4/2009 Hill ..... F02G 1/053 60/520
2009/0217658 A1* 9/2009 Fiedler ..... F25B 9/14 60/519
2010/0186425 A1* 7/2010 Veprik ..... F25B 9/14 62/6
2012/0297880 A1* 11/2012 Moler ..... H02N 2/186 73/514.34
2013/0031915 A1* 2/2013 Bin-Nun ..... F25B 9/14 62/6
2015/0285183 A1* 10/2015 Vatne ..... F02G 1/02 60/521
2016/0223228 A1* 8/2016 Nakano ..... F25B 9/14
2017/0010026 A1* 1/2017 Nakano ..... F25B 9/14
2017/0254570 A1* 9/2017 Veprik ..... F25B 9/14
2018/0205290 A1* 7/2018 Gedeon ..... F02G 1/044
2020/0217568 A1* 7/2020 Tauber ..... F25B 49/022
2020/0224931 A1* 7/2020 Takayama ..... F25B 9/145
2020/0263676 A1* 8/2020 Kuromoto ..... F04B 1/124
2020/0355273 A1* 11/2020 Hoeg ..... F16J 15/56

FOREIGN PATENT DOCUMENTS

JP 04003857 A * 1/1992
JP 06207757 A * 7/1994

OTHER PUBLICATIONS

International Search Report for PCT Application No. PCT/IL2020/050791 dated Oct. 15, 2020.

* cited by examiner

CRYOGENIC STIRLING REFRIGERATOR WITH A PNEUMATIC EXPANDER

FIELD OF THE INVENTION

The present invention relates to cryogenic refrigerators. More particularly, the present invention relates to a cryogenic split Stirling refrigerator with a resonant pneumatic expander.

BACKGROUND OF THE INVENTION

Cryogenic refrigeration systems are widely used for providing and maintaining various payloads at stabilized cryogenic temperatures. For example, an infrared imager typically includes a focal plane array that needs to be cooled in order to reduce dark currents below desired limits, thus improving signal to noise ratio. A typical high resolution infrared imager, therefore, typically includes a mechanical closed-cycle Stirling cryogenic refrigerator (sometimes also referred to as "cryogenic cooler" or "cryocooler").

A typical mechanical Stirling cryogenic cooler includes two major components: a pressure wave generator (e.g., piston compressor) and an expander that includes a resonant piston displacer supported by a spring. A reciprocating motion of a compressor piston provides cyclic pressure pulses and volumetric flow of a gaseous working agent (helium, nitrogen, argon, etc.) in the expansion space of the expander. During an expansion stage of operation of the cryocooler, the expanding working agent performs mechanical work on the moving sealing piston; this results in cooling effect in the working agent contained in the expansion space of the expander and heat absorption from the payload which is thermally attached to the expansion space. During a compression stage of operation of the refrigerator, the working agent is compressed in the compression space of the piston compressor so that the heat absorbed from the payload along with the compression heat is expelled to the ambient environment at a warm end of the resonant expander that is in thermal contact with the environment.

In a split refrigerator, the expander and compressor are separate units that are interconnected by a gas transfer line (e.g., a thin-walled stainless steel tube). This arrangement typically increases flexibility of the system design and isolates the cooled component from vibrations and heat generated by the operation of the piston compressor. In this implementation, the displacer may be actuated pneumatically using net differential force exerted due to the differences of active areas of the driving pistons and applied dynamic pressures.

SUMMARY OF THE INVENTION

There is provided, in accordance with some embodiments of the invention, a split Stirling cryogenic refrigerator device that includes a resonant pneumatic expander comprising a resonant displacer assembly supported by a spring and configured to slide back and forth along a longitudinal axis within a housing of the resonant pneumatic expander. The resonant displacer assembly includes a tubular displacer containing a regenerator and coupled to a sealing piston, and a driving piston coupled to the sealing piston by an elongated radially compliant and axially rigid connecting member. In some embodiments of the invention, a diameter of the tubular displacer is substantially equal to a diameter of the sealing piston.

In some embodiments of the invention, the diameter of the tubular displacer is unequal to the diameter of the driving piston.

In some embodiments of the invention, the diameter of the tubular displacer is greater than the diameter of the driving piston.

In some embodiments of the invention, each of the sealing piston and the driving piston is configured to slide back and forth in a matched bore within a bushing.

In some embodiments of the invention, the sealing piston and the driving piston are configured to slide back and forth within a coaxially arranged cold finger of the expander and proximal and distal bushings.

In some embodiments of the invention, the matched bores are substantially coaxially aligned in a single bushing.

In some embodiments of the invention, the spring is a helical spring.

In some embodiments of the invention, the spring is a planar spring.

In some embodiments of the invention, the spring is a pneumatic spring.

In some embodiments of the invention, the spring is a magnetic spring.

In some embodiments of the invention, the magnetic spring comprises two stationary, axially and similarly polarized permanent magnet rings and a movable, oppositely axially polarized permanent magnetic ring positioned between the two stationary axially polarized permanent magnetic rings.

In some embodiments of the invention, the spring constant of the spring is selected to have a resonance frequency that is substantially equal to a predetermined driving frequency of the cryogenic refrigerator.

In some embodiments of the invention, the connecting member is selected from the group consisting of: a rod, a preloaded helical spring with closed coils and a tube.

In some embodiments of the invention, the driving piston is located at a warm side of the device.

In some embodiments of the invention, the tubular displacer is located in a cold finger of the device.

In some embodiments of the invention, the regenerator includes porous regenerative heat exchanger material.

In some embodiments of the invention, the device includes a transfer line for transferring cyclic pressure pulses into the housing to drive the resonant displacer assembly.

In some embodiments of the invention, the transfer line is located so as to transfer the cyclic pressure pulses into a confined space between the sealing piston and the driving piston.

In some embodiments of the invention, the transfer line is located so as to transfer the cyclic pressure pulses into a confined space behind the driving piston.

BRIEF DESCRIPTION OF THE DRAWINGS

In order for the present invention to be better understood and for its practical applications to be appreciated, the following Figures are provided and referenced hereafter. It should be noted that the Figures are given as examples only and in no way limit the scope of the invention. Like components are denoted by like reference numerals.

DETAILED DESCRIPTION OF THE INVENTION

In the following detailed description, numerous specific details are set forth in order to provide a thorough understanding of the invention. However, it will be understood by those of ordinary skill in the art that the invention may be practiced without these specific details. In other instances, well-known methods, procedures, components, modules, units and/or circuits have not been described in detail so as not to obscure the invention.

Although embodiments of the invention are not limited in this regard, discussions utilizing terms such as, for example, "processing," "computing," "calculating," "determining," "establishing", "analyzing", "checking", or the like, may refer to operation(s) and/or process(es) of a computer, a computing platform, a computing system, or other electronic computing device, that manipulates and/or transforms data represented as physical (e.g., electronic) quantities within the computer's registers and/or memories into other data similarly represented as physical quantities within the computer's registers and/or memories or other information non-transitory storage medium (e.g., a memory) that may store instructions to perform operations and/or processes. Although embodiments of the invention are not limited in this regard, the terms "plurality" and "a plurality" as used herein may include, for example, "multiple" or "two or more". The terms "plurality" or "a plurality" may be used throughout the specification to describe two or more components, devices, elements, units, parameters, or the like. Unless explicitly stated, the method embodiments described herein are not constrained to a particular order or sequence. Additionally, some of the described method embodiments or elements thereof can occur or be performed simultaneously, at the same point in time, or concurrently. Unless otherwise indicated, the conjunction "or" as used herein is to be understood as inclusive (any or all of the stated options).

Figure 1:
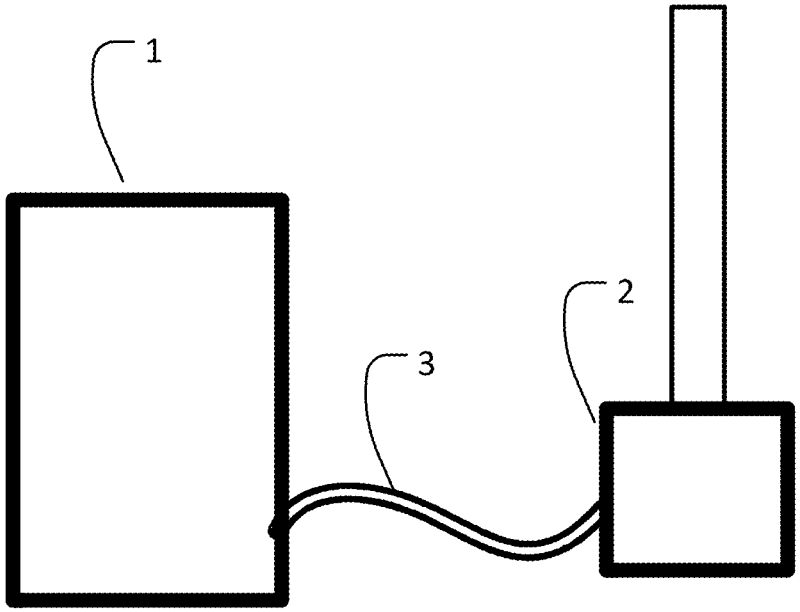
FIG. 1 is a block diagram of a split Stirling cryogenic refrigerator device, according to some embodiments of the invention.

FIG. 1 is a block diagram of a split Stirling cryogenic refrigerator device, according to some embodiments of the invention.

In accordance with an embodiment of the present invention, a cryogenic refrigerator is based on the closed Stirling thermodynamic cycle. The split configuration, according to some embodiments, comprises a piston compressor 1 that includes a compressor (e.g., piston compressor) driven by an electromagnetic actuator and configured to cyclically compress and decompress a gaseous working agent. A compression space of the compressor is connected by a transfer line 3 (e.g., any conduit that is capable of enabling a flow of the working agent) to a warm space of an expander 2 that includes a displacer assembly which is arranged to resonate inside the cold finger. The distal end of the cold finger (e.g., a cold tip of the cold finger) is typically placed in thermal contact with a component or object that is to be cooled to cryogenic temperatures. In this manner, the compressor (which may include the most bulky and massive components of the refrigerator, and which require connection to a source of electrical power) may be located remotely from the object to be cooled. This may enable flexibility in the design of a component that requires cooling.

A distal end of the cold finger tube of the resonant expander is sealed using the cold finger plug, thus forming a cold tip, e.g., which may be placed in thermal contact with an object to be cooled. The cold finger extends distally out of the cold finger base. The outer surfaces of the cold finger base are sealed to prevent any flow of the working agent or another gas in or out of the cooling unit except via the transfer line.

The cold finger tube encloses a displacer assembly that is configured to slide distally and proximally within the cold finger tube. The displacer assembly includes displacer tube enclosing a regenerative heat exchanger, or regenerator. The regenerator typically includes a porous solid material that is configured to enable passage of the gaseous working agent through the regenerator while cyclically absorbing and releasing heat from and to the working agent. A distal (cold) end of the regenerator is open to a cold expansion space that is located at the distal end of the cold finger, between the cold finger plug and the distal end of the regenerator.

A displacer assembly may also include a sealing piston that is coupled to, and constrained to slide with, the displacer tube, a driving piston and an elongated radially compliant and axially rigid connecting member that connects the sealing piston to the driving piston. A compliant connecting member may be in the form of a thin rod, a preloaded helical spring with closed coils (so as not to enable compression, and with a sufficiently large preload force so as to prevent stretching under operating conditions), a thin-walled tube, or similar structure. The axial rigidity of the spring dictates a substantially constant length in the axial direction, which is substantially coaxial with the back and forth motion of the pistons, being substantially incompressible and non-stretchable (e.g., having high longitudinal stiffness) along its longitudinal axis, and being laterally bendable (e.g., has low transverse stiffness) about axes that are orthogonal (radial) to the longitudinal axis.

The sealing piston and the driving piston are configured to slide distally and proximally along a longitudinal axis of the expander within tightly matched distal and proximal bushing bores. A sliding clearance seals are, therefore, configured between the driving piston and the sealing piston and the distal and proximal bushing bores, respectively, in order to prevent flow of the working agent between (i) the cold expansion space and warm space, and (ii) warm and rear space on the other side.

The combined effect of different diameters of the sealing and driving pistons and/or pressure variation facing their faces may exert a net differential cyclic force on the coupled pistons that facilitates resonant drive.

In one example, the warm space may be bounded by the proximal face of the sealing piston and the distal face of the driving piston, the transfer line enters the warm space through a lateral side of the cold finger base, into a confined space between the pistons, and the proximal end of the driving piston protrudes into the rear space bounded by the cold finger base and a rear cover.

The compliant connecting member that connects the sealing piston and the driving piston may be, for example, in the form of an elongated rod of small diameter or a spring with preloaded closed coils. In this example, one or more axial conduits are provided in the sealing piston for pneumatic communication between the warm space and warm side of the regenerator; thus, the dynamic pressure facing both ends of the sealing piston having substantially equal areas is substantially equal, such that no net force is acting upon the sealing piston. As different from the sealing piston, the proximal and distal ends of the driving piston ends protrude pneumatically into isolated warm and rear spaces with different dynamic pressures, whereupon the dynamic pressure in the rear space is negligibly small as compared with dynamic pressure in the warm space, and thus the dynamic net differential force may be applied to the driving piston. In particular, when the dynamic pressure in the warm space is positive, the net differential force is directed outwards the cold finger tip, and, when the dynamic pressure in the warm space is negative, the net differential force is directed towards the cold finger tip.

A resilient connecting member (e.g., a helical spring, a planar spring, a magnetic spring) may be located in the rear space and connect the proximal end of a movable driving piston protruding into the rear space and one of the static components forming the rear space (e.g. lateral walls, a proximal wall, or a bushing end that is located within the rear space). A spring rate or spring constant of the resilient connecting member may be selected (e.g., in light of the masses of the moving assembly, including the sealing piston and driving piston, regenerator, compliant connecting member and the displacer) to have a resonance frequency that is at or close to the driving frequency.

In another example, the warm space may be bounded by the distal end of the sealing piston, distal bushing walls and rear cover, such that the transfer line protrudes into the warm space through the back side of a rear cover.

The compliant connecting member that connects the sealing piston and driving piston may be in the form of an elongated tube of small diameter protruding through axial conduits that are provided in the sealing piston and driving piston for pneumatic communication between the warm space and warm side of the regenerator.

In this example, the rear space is bounded by the distal end of the driving piston, proximal end of the sealing piston, cold finger base walls, proximal and distal ends of the distal and proximal bushings, respectively. The tubular compliant connecting member is located inside the rear space.

The dynamic pressure variation inside the warm space is applied to the proximal end of the driving piston and distal end of the sealing piston, having substantially different face areas. The dynamic pressure variation inside the rear space acting upon the distal end area of the driving piston and upon the proximal end of the sealing piston is negligibly small, and thus the net differential force applied to the coupled pistons may be due to the difference in diameters of the sealing piston and driving piston. In particular, for the proper phase and stroke control as needed for providing efficient cooling effect, the diameter of the driving piston may be substantially smaller than the diameter of the sealing piston, and thus, when the dynamic pressure in the warm space is positive, the net differential force is directed outwards the cold finger tip, and, when the dynamic pressure in the warm space is negative, the net differential force is directed towards the cold finger tip.

A resilient connecting member (e.g., a helical spring, a planar spring, a magnetic spring) may be located in the rear space and connect one of the components of the moving assembly with one of the static components forming the rear space (e.g. lateral walls, a proximal wall, or a bushing end that is located within the rear space). A spring rate or spring constant of the resilient connecting member may be selected (e.g., in light of the masses of the moving assembly, including the sealing piston and the driving piston, regenerator, compliant connecting member and the displacer) to have a resonance frequency that is at or close to the driving frequency.

Figure 2:
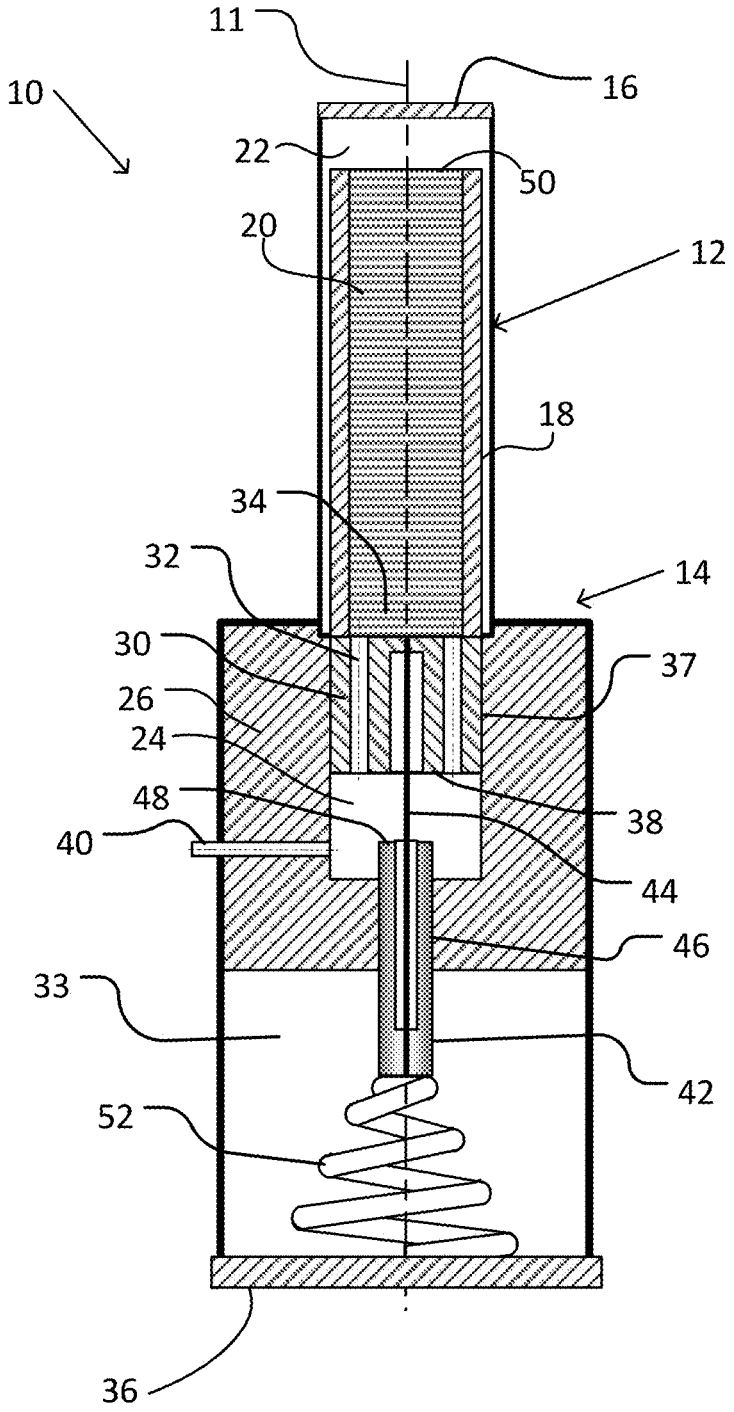
FIG. 2 schematically illustrates a pneumatically driven resonant expander with two pistons connected by a radially compliant and axially rigid connecting member and a helical assisting spring in a rear space, according to some embodiments of the invention.

An expander that includes two compliantly connected pistons may require a less stringent alignment than an expander that incorporates a prior art single-piece stepped piston (e.g., with different diameters at opposite ends) arranged to slide inside the single-piece stepped bushing FIG. 2 schematically illustrates a resonant pneumatic expander with a displacer actuated by a driving piston connected by an elongated radially compliant connecting member and an assisting helical spring in a rear space, according to some embodiments of the invention.

Resonant pneumatic expander 10 of a split Stirling cryogenic cooler may be operated by a piston compressor (not shown) to absorb heat from the payload at low temperature into cold finger plug 16 at a distal end of cold finger 12. Warm space 24, enclosed in cold finger base 14 of a resonant pneumatic expander 10, is connected to the compression space of a piston compressor by transfer line 40 for transferring pneumatic cyclic pressure pulses of a working agent (typically an inert gas, e.g., helium, argon, nitrogen, etc) into between expander 10 and the piston compressor. The piston compressor may be operated with driving frequency as to cyclically increase and decrease the gas pressure of the working agent.

For example, cold finger plug 16 of cold finger 12 may be placed in thermal contact with a region, object, or component that is to be cooled, typically, to cryogenic temperatures. Walls of cold finger 12 may be made of a thermally non-conductive material (e.g., titanium or stainless steel alloy or another suitable material) and are sufficiently thin so as to minimize parasitic heat flow from the warm cold finger base 14 to the cold finger plug 16.

Cold finger base 14 of resonant pneumatic expander 10 of a split Stirling cryogenic cooler encloses bushing 26, rear space 33, driving piston 42, sealing piston 30, and warm space 24. Sealing piston 30 and driving piston 42 may move distally and proximally within tightly matched concentric bores within bushing 26.

Sealing piston 30 is connected to, and constrained to move distally and proximally together with, displacer tube 18. Displacer tube 18 includes regenerative heat exchanger 20 made of porous solid media through which the gaseous working agent can flow and with which the gaseous working agent may exchange heat. For example, regenerative heat exchanger 20 may be fabricated in the form of stacked disks constructed of fine metal or plastic screens or random fiber. Regenerative heat exchanger 20 may have a sufficient heat capacity, heat conductivity and wet surface to facilitate required cyclic heat exchange with gaseous working agent.

Sealing piston 30 includes one or more conduits 32 to enable pneumatic flow of the working agent between warm space 24 and warm end of regenerator 34 at a proximal end of regenerative heat exchanger 20. Thus, the gas pressure of the working agent is substantially identical within both warm space 24 and warm regenerator end 34.

An expansion space 22 is formed within cold finger 12 between a distal (cold) end 50 of regenerative heat exchanger 20 and cold finger plug 16. Distal seal 37 between sealing piston 30 and bushing 26 (e.g., one or more clearance seals or another type of seal) may pneumatically isolate warm space 24 from expansion space 22. Thus, any flow of the working agent between warm space 24 and expansion space 22 is constrained to flow from warm regenerator end 34, regenerative heat exchanger 20, and cold regenerator end 50. Distal and proximal motion of displacer assembly 18 may result in cryogenic cooling effect in the expansion space 22 and, therefore, heat absorption from the heat load mounted at the cold finger plug 16.

Driving piston 42 is connected to sealing piston 30 via elongated compliant connecting member 44. In the example shown, compliant connecting member 44 may include an elongated thin rod (e.g., metal or plastic), a helical spring with preloaded closed coils, or another elongated mechanical component that has a substantially constant length (e.g., is substantially incompressible and non-stretchable in the elongated dimension parallel to longitudinal axis 11), but is bendable about axes that are perpendicular to longitudinal axis 11. Accordingly, driving piston 42 and sealing piston 30 are constrained to move together along the direction of longitudinal axis 11. Proximal seal 46 between driving piston 42 and bushing 26 (e.g., one or more clearance seals or another type of seal) may pneumatically isolate warm space 24 from rear space 33.

Gas pressure of the working agent may act on face surfaces of driving piston 42 and sealing piston 30. Since distal and proximal face surfaces of sealing piston 30 and pressures acting upon them are substantially equal, a dynamic pressure applied to the sealing piston 30 does not produce a differential net force. At the same time, since the volume of the isolated rear space is substantially larger than the rear volume variation due to a cyclic protrusion of piston 42, the pressure in the rear space is close to the mean charge pressure. Therefore, the dynamic gas pressure in the warm space 24 acting on the face surface 48 may exert a proximal force on the proximal piston 42. Since the magnitude of this force equals magnitude of the pressure variation times the area of face surface, the magnitude of this force may be controlled by choosing the diameter of the piston 42, which, therefore, may be called "driving rod".

Motion of displacer assembly including displacer 18, regenerator 20, compliant connecting member 44, driving piston 42 and sealing piston 30 may be assisted by a resilient connecting member. In the example shown, the resilient connecting member is in the form of helical spring 52. In the example shown, helical spring 52 is located within rear space and extends between proximal rear cover 36 sealing the cold finger base 14 and the proximal end of driving piston 42. For example, a spring rate of helical spring 52 may be predetermined such that a resonant frequency of motion sprung displacer assembly (18,20,44,42 and 30) is substantially equal to a driving frequency, e.g. $K=M\omega^2$, where $$K\left[\frac{N}{m}\right]$$

is the spring rate, M [kg] is the mass of displacer assembly and $$\omega\left[\frac{\text{rad}}{s}\right]$$

is the circular driving frequency.

In other examples, the resilient element may include, a magnetic spring (e.g., as described below), a planar spring, a pneumatic spring, or another type of resilient connecting member, or combinations thereof.

Figure 3:
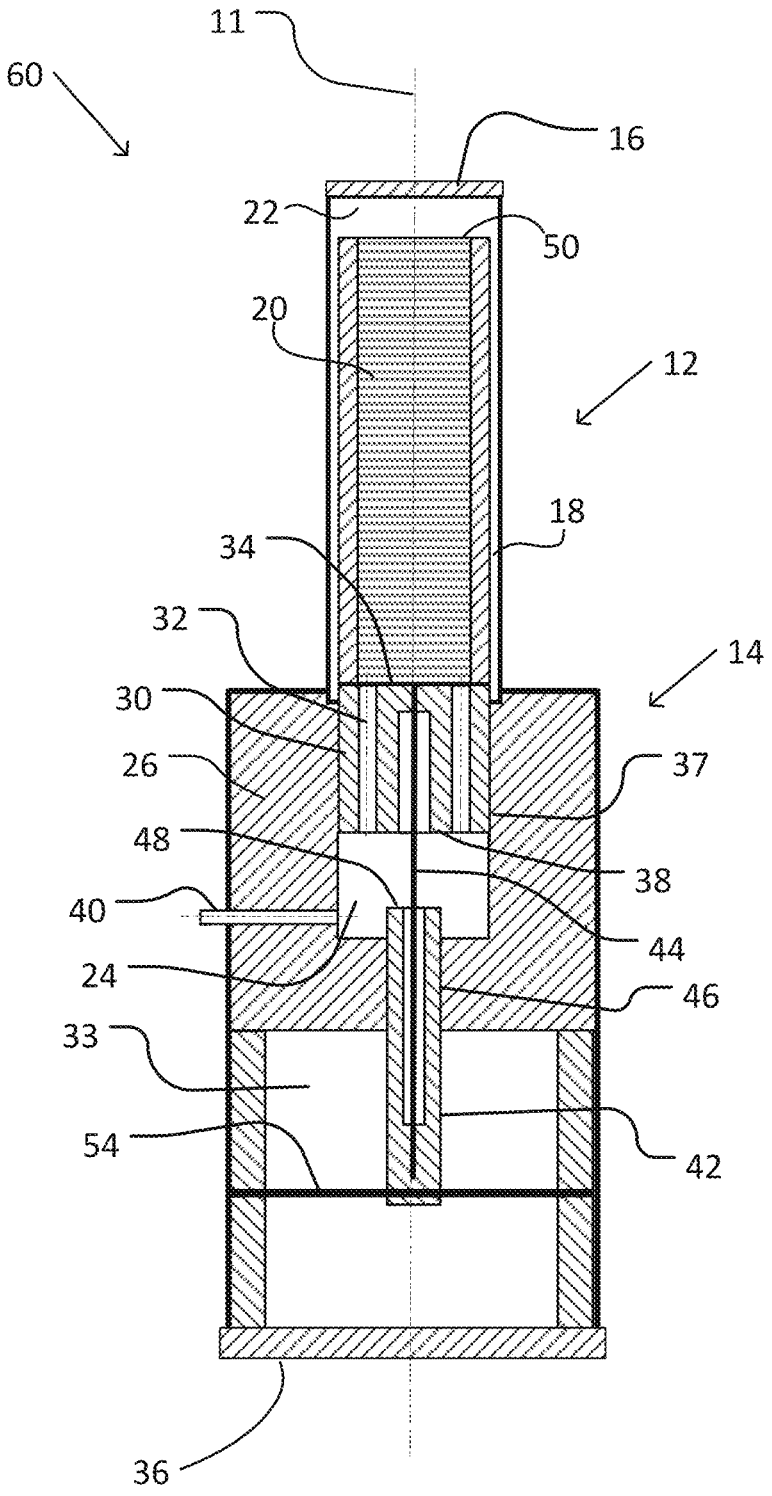
FIG. 3 schematically illustrates a pneumatically driven resonant expander, with a planar assisting spring in a rear space, according to some embodiments of the invention.

FIG. 3 schematically illustrates a resonant pneumatic expander with a planar assisting spring in a rear space, according to some embodiments of the invention.

In a resonant pneumatic expander 60, an assisting resilient connecting member is in the form of planar spring 54. Planar spring 54 may be constructed in the form of at least one planar thin circular disk with at least two spiral slots and may be centrally attached to the proximal end of driving piston 42 and peripherally attached to stationary interior walls of rear space 33. For example, a spring rate of planar spring 54 may be predesigned such that a resonant frequency of motion sprung displacer assembly (18,20,44,42 and 30) is substantially equal to a driving frequency, as explained above.

Figure 4:
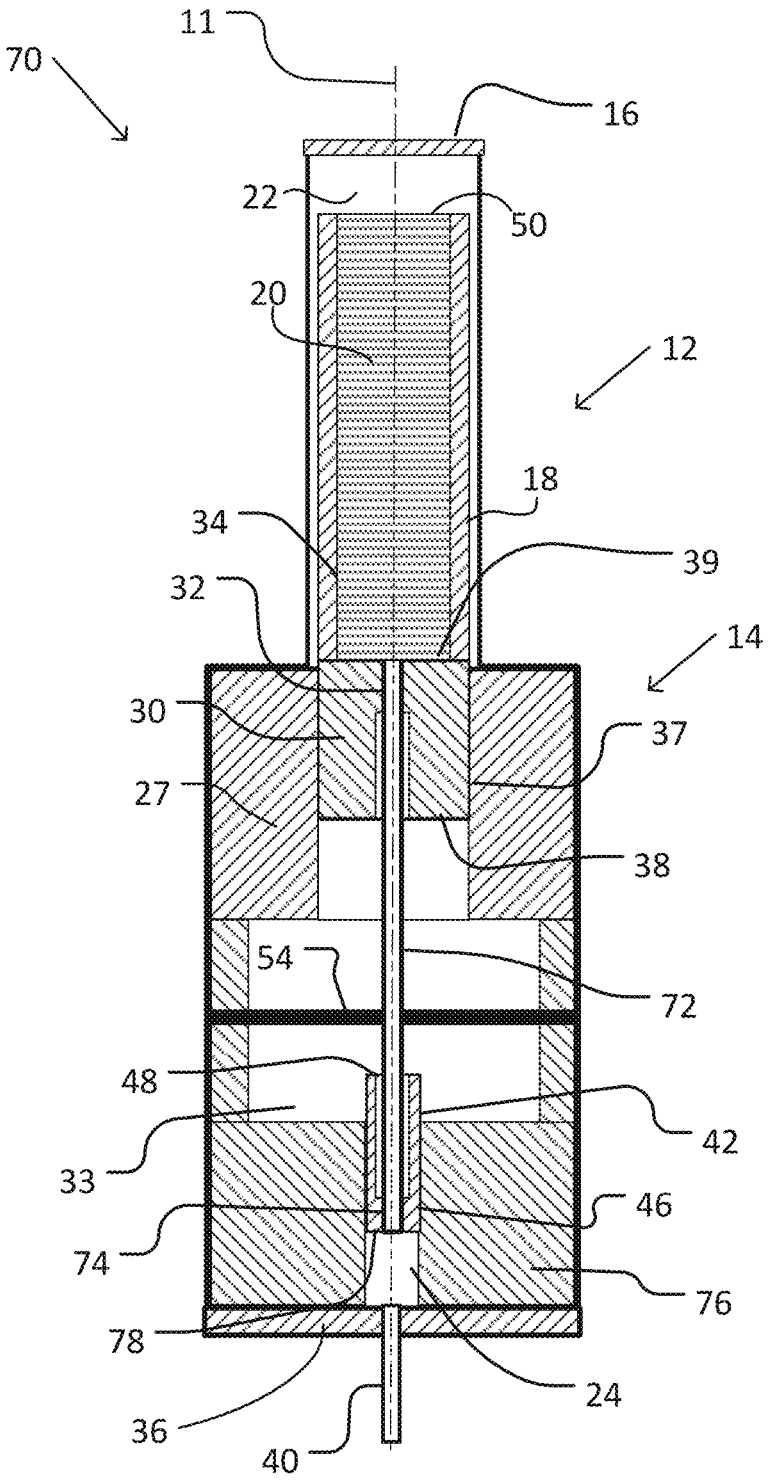
FIG. 4 schematically illustrates a pneumatically driven resonant expander, with a tubular compliant connecting member that pneumatically connects a warm space with a regenerator, according to some embodiments of the invention.

FIG. 4 schematically illustrates a resonant pneumatic expander, with a tubular compliant link that mechanically connects the driving piston and the sealing piston and pneumatically connects a warm space with a regenerator, according to some embodiments of the invention.

In resonant pneumatic expander 70, the transfer line 40 protrudes through the rear cover 36 (which seals the cold finger base) so that cyclic pressure pulses transferred through the transfer line 40 are introduced into the warm space provided in cold finger base 14, behind driving piston 42. Warm space 24 is bounded by rear cover 36, proximal bushing 76, and proximal face 78 of driving piston 42 (which is located distally to warm space 24). Driving piston 42 is configured to move distally and proximally (along longitudinal axis 11) within a tightly matched bore of proximal bushing 76.

Driving piston 42 is connected to sealing piston 30 by compliant tube 72, which protrudes through rear space 33 (which is also distal to warm space 24). Sealing piston 30 is configured to move distally and proximally (along longitudinal axis 11) within a tightly matched bore of distal bushing 27. Driving piston 42 includes conduit 74, and sealing piston 30 includes conduit 32. Compliant tube 72 pneumatically connects between conduit 74 and conduit 32. Thus, compliant tube 72, conduit 74 and conduit 32 enable a pneumatic path between warm space 24 and warm end of regenerator 34.

In this case, as different to above explained example, dynamic pressure of the working agent may act upon proximal face 78 of driving piston 42 and on the proximal face 39 of sealing piston 30 at the warm end of regenerator 34. The distal face of the driving piston 78 and the distal face of sealing piston 30 protrude the rear space 33 where the dynamic pressure is negligibly small at all times. Accordingly, a net proximal force may be applied to the moving assembly that is equal to the difference in surface areas between the distal face 39 of sealing piston 30 and proximal face 78 of driving piston 42 times pressure in the warm space 24

In this example, an assisting resilient element in the form of planar spring 54 is attached to the perimeter of compliant tube 72 and to the stationary interior walls of rear space 33. A spring rate of planar spring 54 may be predesigned such that a resonant frequency of motion of sprung displacer assembly is substantially equal to a driving frequency, as explained above.

Figure 5:
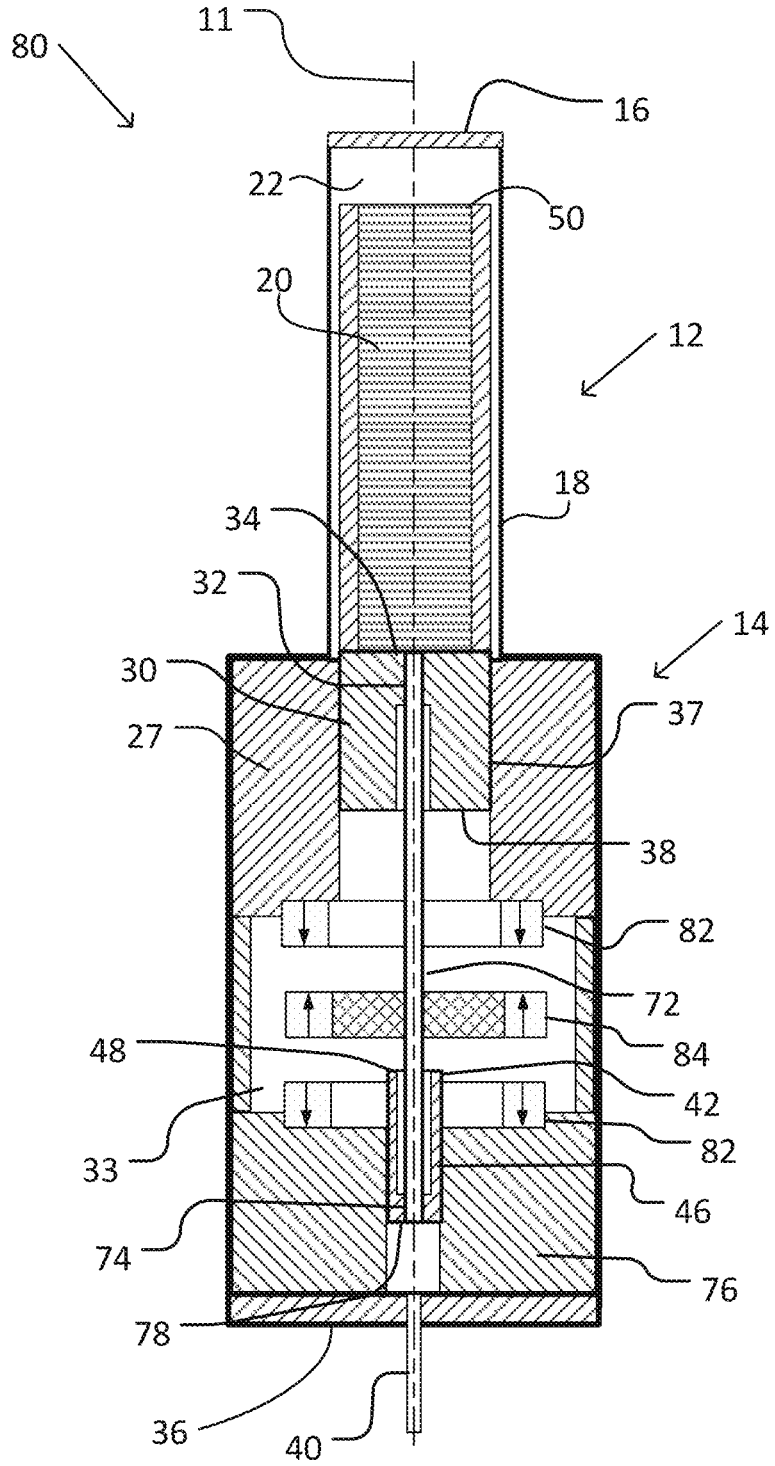
FIG. 5 schematically illustrates a pneumatically driven resonant expander, with a magnetic assisting spring, according to some embodiments of the invention.

FIG. 5 schematically illustrates a resonant pneumatic expander, with a magnet assisting spring, according to some embodiments of the invention.

In resonant pneumatic expander 80, one of two axially polarized permanent magnet rings 82 is attached to distal bushing 27, and the other is attached to proximal bushing 76. Oppositely axially polarized permanent magnetic ring 84 is attached to compliant tube 72 within rear space 33 between identically axially polarized permanent magnetic rings 82. In this example, oppositely polarized permanent magnetic disk 84 is repelled by both identically axially polarized permanent magnetic rings 82, thus forming a failure free magnetic spring which is more cost efficient as compared with planar spring.

Different embodiments are disclosed herein. Features of certain embodiments may be combined with features of other embodiments; thus, certain embodiments may be combinations of features of multiple embodiments. The foregoing description of the embodiments of the invention has been presented for the purposes of illustration and description. It is not intended to be exhaustive or to limit the invention to the precise form disclosed. It should be appreciated by persons skilled in the art that many modifications, variations, substitutions, changes, and equivalents are possible in light of the above teaching. It is, therefore, to be understood that the appended claims are intended to cover all such modifications and changes as fall within the true spirit of the invention.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

The invention claimed is:

1. A split Stirling cryogenic refrigerator device comprising:

a resonant pneumatic expander comprising a resonant displacer assembly supported by a spring and configured to slide back and forth along a longitudinal axis within a housing of the resonant pneumatic expander, the resonant displacer assembly comprising a tubular displacer containing a regenerator and coupled to a sealing piston, and a driving piston coupled to the sealing piston by an elongated radially compliant and an axially rigid connecting member, wherein the connecting member comprises a preloaded helical spring with closed coils.

2. The device of claim 1, wherein a diameter of the tubular displacer is substantially equal to a diameter of the sealing piston.

3. The device of claim 1, wherein a diameter of the tubular displacer is unequal to a diameter of the driving piston.

4. The device of claim 3, wherein the diameter of the tubular displacer is greater than the diameter of the driving piston.

5. The device of claim 1, wherein each of the sealing piston and the driving piston is configured to slide back and forth in a matched bore within a bushing.

6. The device of claim 5, wherein the sealing piston and the driving piston are configured to slide back and forth within a coaxially arranged cold finger of the expander and proximal and distal bushings.

7. The device of claim 5, wherein the matched bores are substantially coaxially aligned in a single bushing.

8. The device of claim 1, wherein the spring is a helical spring.

9. The device of claim 1, wherein the spring is a planar spring.

10. The device of claim 1, wherein the spring is a pneumatic spring.

11. The device of claim 1, wherein the spring is a magnetic spring.

12. The device of claim 11, wherein the magnetic spring comprises two stationary axially and similarly polarized permanent magnet rings and a movable oppositely axially polarized permanent magnetic ring positioned between the two stationary axially polarized permanent magnetic rings.

13. The device of claim 1, wherein the spring constant of the spring is selected to have a resonance frequency that is substantially equal to a predetermined driving frequency of the cryogenic refrigerator.

14. The device of claim 1, wherein the driving piston is located at a warm side of the device.

15. The device of claim 1, wherein the tubular displacer is located in a cold finger of the device.

16. The device of claim 1, wherein the regenerator includes porous regenerative heat exchanger material.

17. The device of claim 1, comprising a transfer line for transferring cyclic pressure pulses into the housing to drive the resonant displacer assembly.

18. The device of claim 17, wherein the transfer line is located so as to transfer the cyclic pressure pulses into a confined space between the sealing piston and the driving piston.

19. The device of claim 17, wherein the transfer line is located so as to transfer the cyclic pressure pulses into a confined space behind the driving piston.

* * * * *